United States Patent [19]

Eltzroth

[11] 4,105,151

[45] Aug. 8, 1978

[54] CRANE CONVERSION METHOD

[76] Inventor: James L. Eltzroth, 282 Westgate St., Wadsworth, Ohio 44281

[21] Appl. No.: 823,597

[22] Filed: Aug. 11, 1977

[51] Int. Cl.[2] ..... B23K 31/02

[52] U.S. Cl. ..... 228/170; 228/119; 228/189; 212/59 R; 212/144; 214/145 R

[58] Field of Search ..... 228/119, 170, 189; 214/130 R, 138 R, 145 R; 212/59 R, 144

[56] References Cited

U.S. PATENT DOCUMENTS

| | | | |
|---|---|---|---|
| 3,149,730 | 9/1964 | Mork | 212/59 |
| 3,777,918 | 12/1973 | Barber | 214/138 R |

*Primary Examiner*—Donald G. Kelly
*Assistant Examiner*—K. J. Ramsey
*Attorney, Agent, or Firm*—Reese Taylor

[57] ABSTRACT

Method and apparatus for altering or retrofitting an excavating crane such as a trench hoe, back hoe, etc., into a lifting crane suitable for scrap handling are disclosed. The conversion is accomplished by cutting V-shaped notches into the side plates of a conventional boom at a point adjacent and outboard of the point of connection between the main hydraulic piston and the main boom; bending the boom so that the edge surfaces formed by the sides of the V-shaped notches are brought into abutment and welding the same together. In this fashion the geometry of the main boom is altered without any necessity for altering either the pivot point, the stroke of the pistons, or any other portion of the overall crane in order to change the lifting arc and permit a greater lifting capability. By this modification, the crane becomes suitable for scrap handling wherein the problem is mainly lifting substantial weights, as contrasted to excavating operations where the reach of the boom arm is of primary importance. The invention also contemplates applying reinforcing plates adjacent the weld point to strengthen the completed unit.

3 Claims, 6 Drawing Figures

FIG. 1
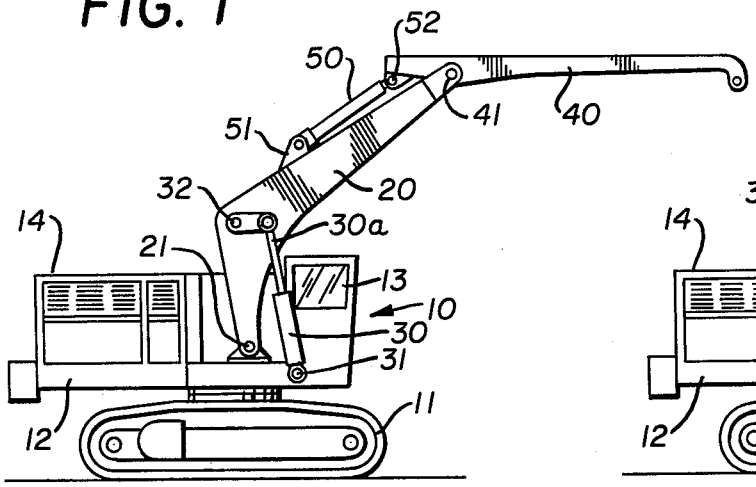
FIG. 2
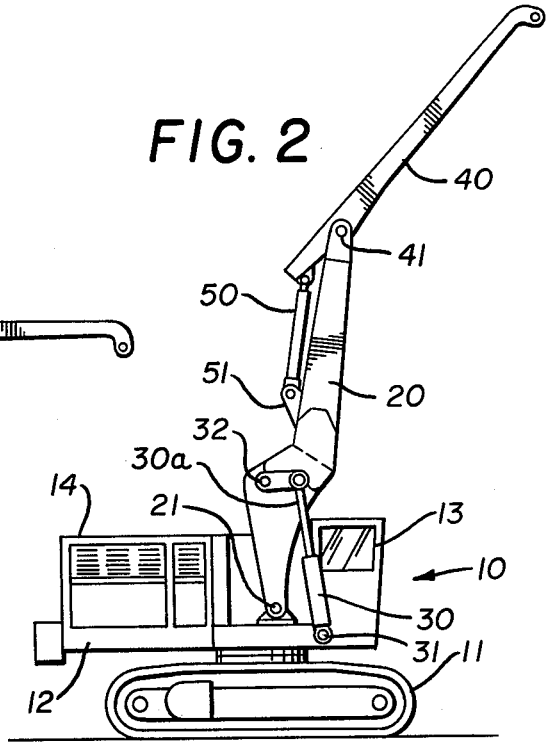
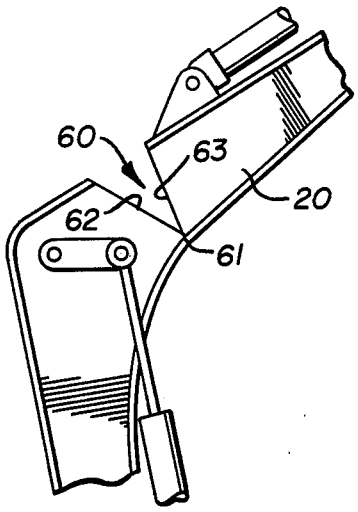
FIG. 3
FIG. 4
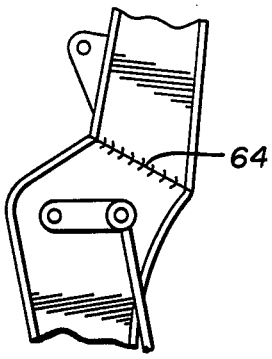
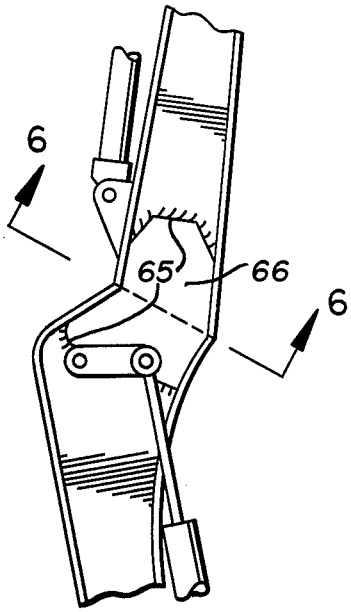
FIG. 5
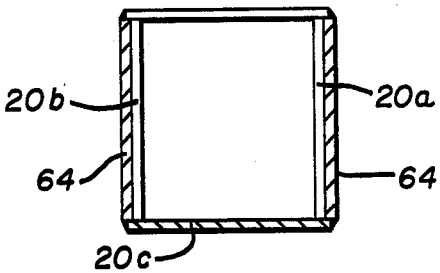
FIG. 6

CRANE CONVERSION METHOD

RELATED APPLICATIONS

None.

BACKGROUND OF THE INVENTION

This invention relates, in general, to heavy-duty cranes and relates, in particular, to a method and apparatus for converting a conventional crane designed primarily for digging or excavating purposes to one primarily designed for lifting purposes, with a minimum of modification and alteration to the basic unit.

PRIOR ART STATEMENT

There are a number of known cranes on the market generally including a working platform mounted on a variety of carriages and being pivotable thereon about a vertical axis. These units, generally, have a substantially L-shaped main boom which is pivotably mounted about a horizontal axis on the working platform and is movable to elevated or depressed condition by means of a hydraulic cylinder and piston. These cranes may be generically referred to as "knuckle boom" cranes.

The outboard end of the main boom generally carries a jib boom which will have a shovel or other type excavating device on it. Such a boom is capable of reaching out from the working platform and, indeed, capable of being depressed so as to dig below the surface of the ground.

The prior art also discloses lifting-type cranes which have a somewhat sharper angular configuration to the main boom and which swing in an arc which permits greater weights to be lifted because of the fact that the arc is somewhat shorter.

However, both of the crane units just described are specifically designed for a specific purpose.

Much the same can be said of the hoists or cranes disclosed in Woodside U.S. Pat. No. 3,669,281; Suverkrop U.S. Pat. No. 3,754,666; and Nakajo U.S. Pat. No. 3,870,162.

Thus, Woodside U.S. Pat. No. 3,669,281 discloses a specially designed boom and jib designed for lifting purposes.

Suverkrop U.S. Pat. No. 3,754,666 discloses a folding crane designed for lifting purposes with the capability of almost vertical lifting.

Nakajo U.S. Pat. No. 3,870,162 is another foldable crane capable of achieving nearly vertical lifting.

However, none of the art known to Applicant discloses a method for converting a digging-type crane to the lifting-type crane without completely replacing the main boom arm which method is the principal object of the invention.

SUMMARY OF THE INVENTION

It has been found that what may be called a digging-type crane can be converted to a lifting-type crane simply, economically, and effectively by simply cutting V-shaped notches in the side panels of the main boom adjacent its point of interconnection with the main hydraulic cylinder and outboard thereof. Once this has been done, it is a simple matter to bring the opposed edges of the V-shaped notch together and weld them securely together. In this fashion, the basic geometry of the main boom is altered so that the operating arc is thrown up into the air rather than out into the ground. This permits a much greater lifting capability both from the standpoint of the weight which can be lifted and the elevation to which that weight can be lifted, since the outboard end of the jib is thus thrown much higher into the air. All of this is accomplished without modification of any other part of the overall crane assembly.

It has also been found that even greater improved results can be achieved by welding or otherwise securing reinforcing plates in an overlying relationship to the point of welding.

Accordingly, accomplishment of an improved method for retrofitting or modifying digging-type cranes to make them suitable for lifting operations becomes the principal object of this invention, with other objects thereof becoming more apparent upon a reading of the following brief specification, considered and interpreted in view of the accompanying drawings.

OF THE DRAWINGS

FIG. 1 is an elevational view of a conventional digging-type crane.

FIG. 2 is a view similar to FIG. 1 following modification of the main boom.

FIG. 3 is a partial elevational view showing the main boom with the V-shaped notches cut therein.

FIG. 4 is a view similar to FIG. 3 showing the edges of the notches welded together.

FIG. 5 is a view similar to FIGS. 3 and 4 showing the reinforcing plates in position.

FIG. 6 is a sectional view taken along the line 6—6 of FIG. 5.

BRIEF DESCRIPTION OF THE PREFERRED EMBODIMENT

Referring first to FIG. 1 of the drawings, it will be noted that the crane, generally indicated by the numeral 10, includes a crawler-type track system 11, a working platform 12 which supports an operator's cab 13, and a power source 14. The working platform 12 is mounted or secured to the crawler or track mechanism 11 in a pivotable arrangement, with all of this structure being quite conventional and well known in the art. In that regard, this structure has been shown schematically only, since this type of overall arrangement is very well known. It should also be noted that a tracked support has been illustrated but it will be understood that cranes of this general type are also commonly mounted on trucks or wagons, for example.

Mounted on the working platform 12 is a main boom 20 which is pivotally supported on the platform as at 21 so that the boom 20 can be elevated or depressed, as desired, in response to actuation of the main hydraulic cylinder 30 and the piston **30*a* which is itself pivotally mounted to the platform at 31 and secured to the boom 20 at 32**.

Again, this basic structure is known in the art and has not been described in great detail.

A jib 40 is pivotally mounted at 41 on the outer end of the main boom 20. Main boom 20 carries a support bracket 51 which mounts a second hydraulic cylinder 50 which is in turn secured to the jib at 52 so that the jib itself can be manipulated independently of the main boom 20.

Once more, this structure is essentially conventional.

FIG. 1 illustrates a boom having a configuration which is common for excavating or digging-type cranes so that maximum reach out away from the working platform is achieved both in a direction parallel to the ground as well as in a direction beneath the ground line.

It should be noted here that in FIG. 1 job 40 is at its maximum elevation.

In retrofitting, according to the method of this invention, reference is made first to FIG. 3 of the drawings wherein it will be noted that a V-shaped notch, generally indicated by the arrow 60, is cut into each of the side plates 20*a* and 20*b* of the main boom 20 at a point that is outboard of the point of attachment 32 of the main hydraulic cylinder and piston 30. The apex of the notch, indicated at 61 in FIG. 3, is directed toward the bottom plate 20*c* of the boom 20. The side edges 62 and 63 of the notch are also illustrated in FIG. 3, with it being noted that only one side of the boom is shown, but that a similar notch is cut in both side plates 20*a* and 20*b* of the main boom 20 and the notches are in alignment.

Once the notches have been cut, the boom is pivoted about the apex 61 of each of the notches so that the edges 62 and 63 of each side plate 20*a* and 20*b* are brought into abutment, following which they are welded together as at 64 (See FIG. 4). FIGS. 2 and 5 clearly show the new configuration of the main boom 20 following the cutting and welding steps.

It has been found furthermore that improved results can be obtained by welding a plate 66 as at 65, (see FIG. 5) to the outboard faces of sidewalls 20*a* and 20*b* in overlying relationship to the weld 64.

Referring to FIG. 2 of the drawings, it will be noted that effectively the arc of movement possible with the crane has then been altered so as to throw the arc up into the air, in effect, and permit much greater elevation for lifting purposes. Comparison of the jib position of FIGS. 1 and 2 will illustrate the difference in operating capabilities. Thus, FIG. 1 illustrates maximum elevation prior to retrofitting while FIG. 2 shows maximum elevation after retrofitting.

This is particularly important with regard to scrap handling operations wherein a load is picked off the ground and deposited in a receptacle such as a hopper, a truck, etc. Furthermore, the lifting capacity of the crane will have been greatly enhanced because of the fact that the lifting operation takes place more in a direct line and closer to the center of gravity of the prime mover.

Thus, a crane which has been primarily designed for digging or excavating purposes will have been converted into one whose primary function and feasibility will be for lifting purposes.

It should be noted that all of this will be accomplished without modification of any part of the overall crane assembly or relocation of any of the components thereof, except for the simple step of cutting the notches in the main boom 20 and joining the edges of the notches together to effectively change the geometry of the main boom 20 and thereby completely transform the operating characteristics of the overall crane assembly 10. No changes in the jib, except for replacing the usual bucket, are required. Nor are piston 80 and 50 required to be modified.

While a full a complete description of the invention has been set forth in accordance with the dictates of the Patent Statues, it should be understood that modifications can be resorted to without departing from the spirit hereof or the scope of the appended claims.

What is claimed is:

1. A method of retrofitting a knuckle boom crane designed for excavating purposes comprising the steps of A. cutting V-shaped notches into the sidewalls of the main boom with the apexes of the notches directed toward the bottom wall of the boom;

B. bending said boom so that the edge surfaces formed by said cutting step are in abutment with each other; and C. welding said edge surfaces together.

2. The method of claim 1 wherein reinforcing plates are secured to the outer surface of the sidewalls of said boom in overlying relationship with the point of welding.

3. The method of claim 1 wherein said notches are cut at a point between the interconnection of main boom and its associated hydraulic piston and the outboard end of the boom.

* * * * *